US008485073B1

(12) United States Patent
Lopez

(10) Patent No.: US 8,485,073 B1
(45) Date of Patent: Jul. 16, 2013

(54) VIPER CRESCENT WRENCH DEVICE

(76) Inventor: Sergio Lopez, Brea, CA (US)

( * ) Notice: Subject to any disclaimer, the term of this patent is extended or adjusted under 35 U.S.C. 154(b) by 335 days.

(21) Appl. No.: 13/065,608

(22) Filed: Mar. 25, 2011

Related U.S. Application Data

(60) Provisional application No. 61/341,095, filed on Mar. 26, 2010.

(51) Int. Cl.
*B25B 13/22* (2006.01)

(52) U.S. Cl.
USPC ..... 81/134; 81/129.5; 81/133

(58) Field of Classification Search
USPC ..... 81/129.5, 133, 134
See application file for complete search history.

(56) References Cited

U.S. PATENT DOCUMENTS 2,613,567 A 10/1952 Tenerowicz et al.
3,202,022 A * 8/1965 Lothaire ..... 81/357
3,406,558 A * 10/1968 Tillmann et al. ..... 72/416
4,542,583 A 9/1985 Anderson et al.
4,944,204 A 7/1990 West

* cited by examiner

*Primary Examiner* — Lee D Wilson
*Assistant Examiner* — Shantese McDonald
(74) *Attorney, Agent, or Firm* — Emery L. Tracy

(57) ABSTRACT

A viper crescent wrench device for holding a work piece is provided. Upon squeezing a second handle toward a first handle, a first pawl and a second pawl move an adjusting bar toward the first handle thereby moving a second jaw portion toward a first jaw portion. Upon releasing the second handle, the first pawl and the second pawl releasably lock into place and the second handle readjusts relative to the first pawl thereby repositioning to do the same action again when the second handle is squeezed again until the work piece is secured between the first jaw portion and the second jaw portion. Upon rotation of a release mechanism, toothed notches are rotated out of contact with the first pawl and the second pawl such that the second jaw portion moves away from the first jaw portion under bias of a first spring thereby releasing the work piece.

20 Claims, 9 Drawing Sheets

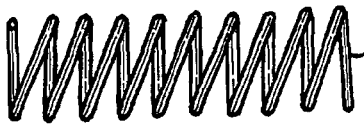
FIG.7
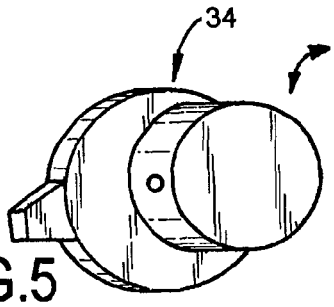
FIG.5
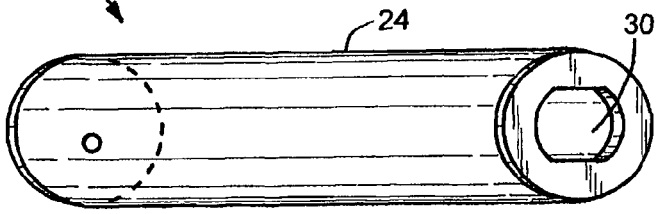
FIG.4
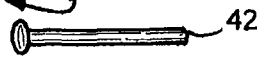
FIG.6
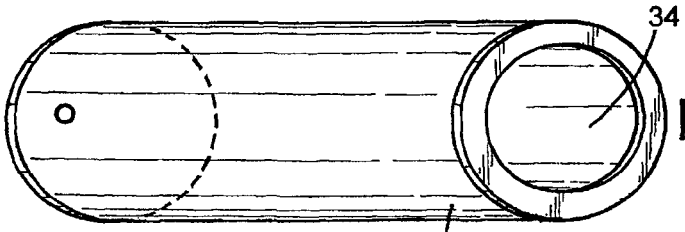
FIG. 10
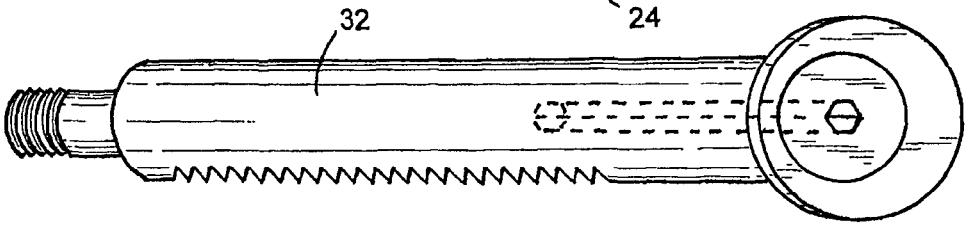
FIG.11
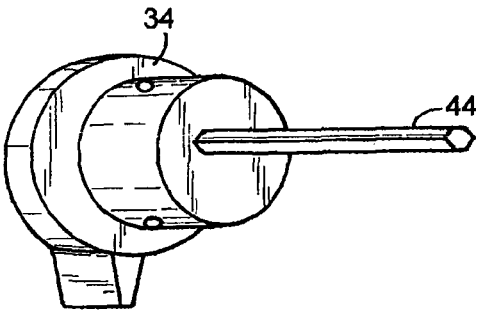
FIG.13
FIG.12
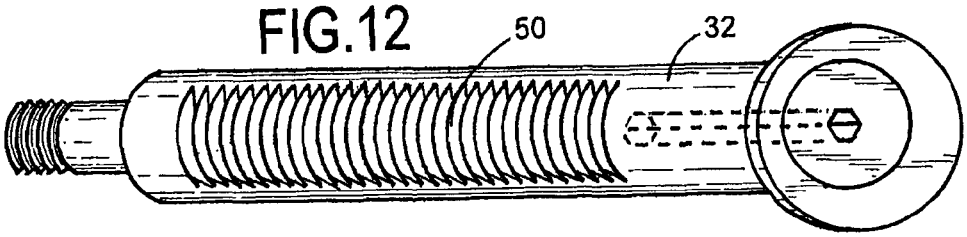

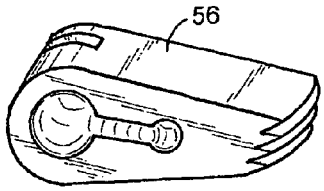
FIG.18
FIG.9
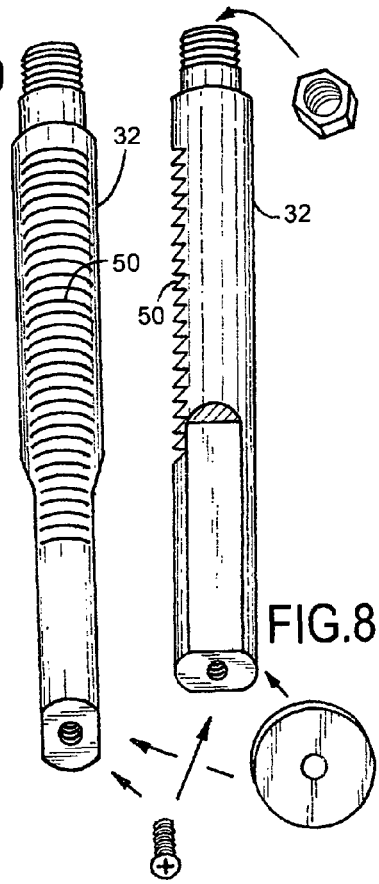
FIG.8
FIG.17
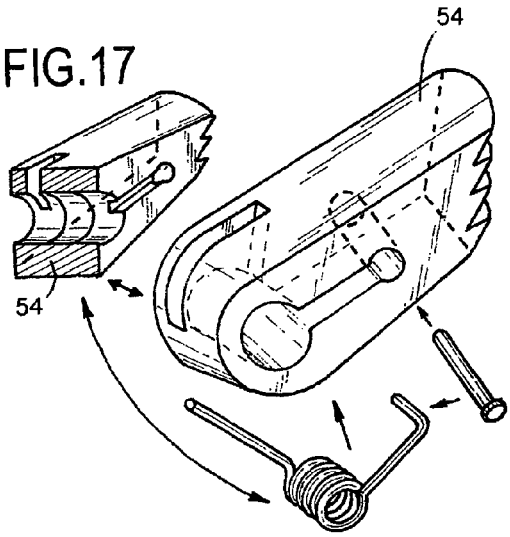
FIG.16
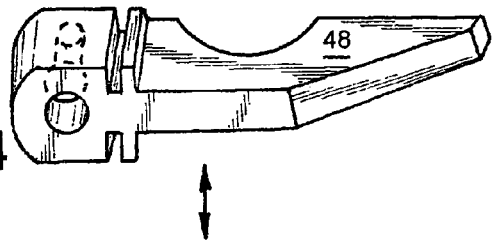
FIG.14
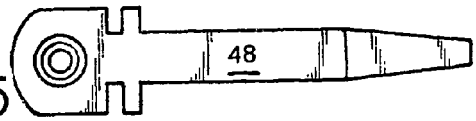
FIG.15

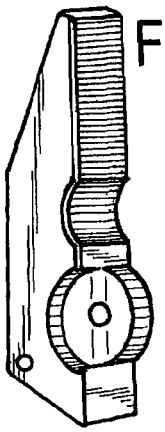
FIG.28
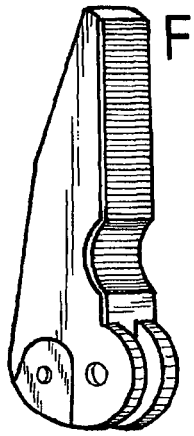
FIG.27
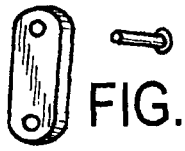
FIG.26
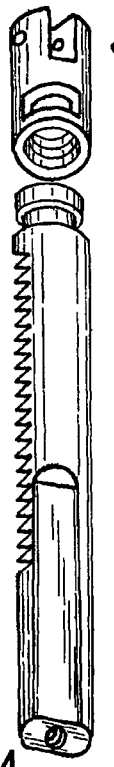
FIG.25
FIG.24
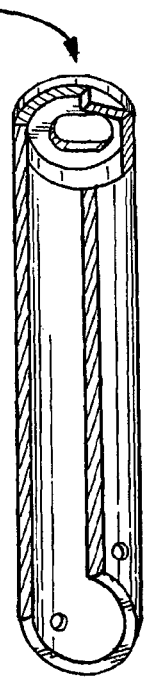
FIG.23

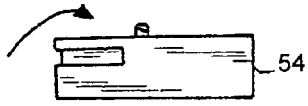
FIG.38
FIG.36
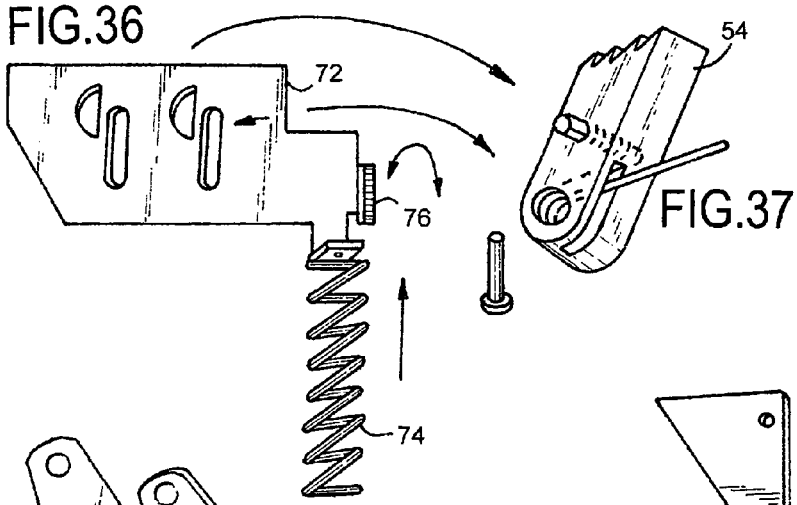
FIG.37
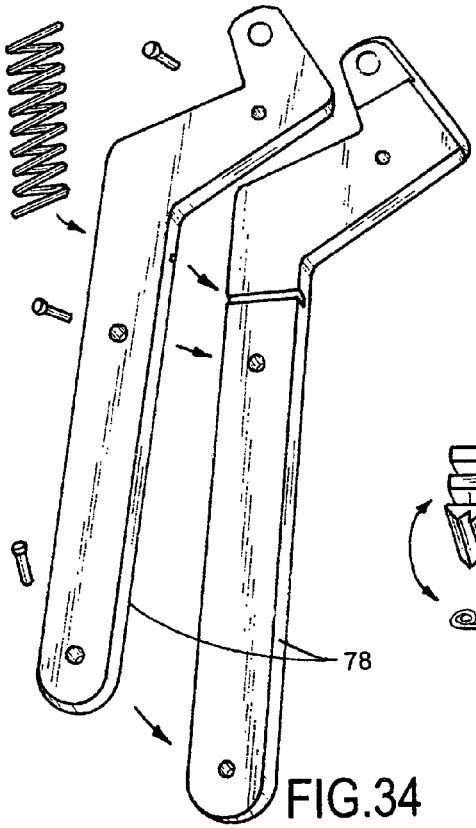
FIG.34
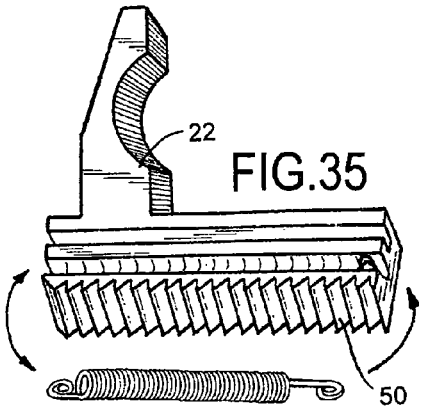
FIG.35
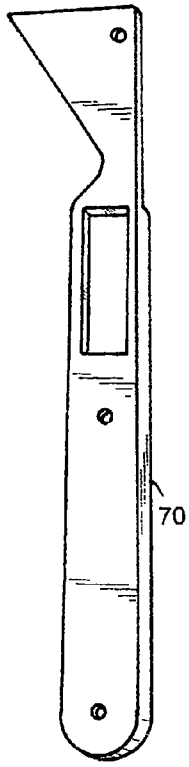
FIG.33

VIPER CRESCENT WRENCH DEVICE

The present application claims the benefit of priority of pending provisional patent application Ser. No. 61/341,095, filed on Mar. 26, 2010, entitled "Viper Crescent".

BACKGROUND OF THE INVENTION

1. Field of the Invention

This invention relates generally to a viper crescent wrench device and, more particularly, the invention relates to a viper crescent wrench device having a spring-loaded, tooth-and-lever channel system in which squeezing the wrench's spring-loaded handle causes the bottom jaw of the device to exact increased force and a tighter fit on nuts, bolts, and other hard-to-turn fasteners and releasing the wrench's jaws is accomplished by turning and pulling a simple release bar at the base of the handle.

2. Description of the Prior Art

Many types of handheld utility pliers are known in the art. Conventional pliers typically include two plier members interconnected in a scissor-like arrangement allowing for a work piece to be grasped by jaw portions of the pliers in response to movement of handle portions of the pliers. A regular crescent wrench is generally comprised of a handle having one end terminating in a fixed jaw, a movable jaw coupled to the handle and moved relative to the fixed jaw, and a thumbscrew mounted in a hole in the handle and turned with the thumb to move the movable jaw relative to the fixed jaw. This structure of crescent wrench is not satisfactory in function because the movable jaw tends to be forced out of position during the operation of the crescent wrench. In order to stop the movable jaw in position, much pressure must be employed to the thumbscrew through the thumb.

Over the years, numerous improvements have been made to the conventional plier design in order to obtain a better and more efficient plier. For example, self-adjusting pliers have been developed in order to provide a set of pliers that more easily adjust to the size of a given work piece. In addition, self-locking pliers have been developed in order to provide a set of pliers that will allow the pliers to remain in locking engagement with the work piece. None of these, however, are satisfactory for efficiently and reliably holding the work piece in position.

SUMMARY

The present invention is a viper crescent wrench device for holding a work piece. The viper crescent wrench device comprises a hollow first handle having an open first end and a second end with a first slot formed in the first handle. A fixed, non-movable first jaw portion is secured to the second end of the first handle. An adjusting bar is rotatably mounted within the first handle with the adjusting bar having a first end and a second end. A plurality of toothed notches are formed on one side of the adjusting bar. A first spring biases the adjusting bar toward the first end of the first handle. A second jaw portion is mounted to the second end of the adjusting bar with the second jaw portion movable toward and away from the first jaw portion. A second handle is pivotable relative to the first handle with the second handle having a first end and a second end. A second spring biases the first end of the second handle in a general direction away from the first handle. A first spring-loaded pawl is pivotally mounted to the second end of the second handle with the first pawl selectively interacting with the toothed notches of the adjusting bar through the first slot. A second spring-loaded pawl selectively interacts with the toothed notches of the adjusting bar through the first slot. A release mechanism cooperates with the adjusting bar to rotate toothed notches of the adjusting bar out of contact with the first pawl and the second pawl. Upon squeezing the second handle toward the first handle, the first pawl and the second pawl move the adjusting bar in a direction toward the second end of the first handle thereby moving the second jaw portion in a general direction toward the first jaw portion. Upon releasing the second handle, the first pawl and the second pawl releasably lock into place and the second handle readjusts relative to the first pawl thereby repositioning to do the same action again when the second handle is squeezed again until the work piece is secured between the first jaw portion and the second jaw portion. Upon rotation of the release mechanism, the toothed notches are rotated out of contact with the first pawl and the second pawl such that the second jaw portion moves in a general direction away from the first jaw portion under bias of the first spring thereby releasing the work piece.

In addition, the present invention includes a method for holding a work piece. The method comprises providing a hollow first handle having an open first end and a second end, forming a first slot in the first handle, securing a fixed, non-movable first jaw portion to the second end of the first handle, rotatably mounting an adjusting bar within the first handle with the adjusting bar having a first end and a second end, forming a plurality of toothed notches on one side of the adjusting bar, biasing the adjusting bar toward the first end of the first handle, mounting a second jaw portion to the second end of the adjusting bar with the second jaw portion movable toward and away from the first jaw portion, pivotally mounting a second handle relative to the first handle with the second handle having a first end and a second end, biasing the first end of the second handle in a general direction away from the first handle, pivotally mounting a first spring-loaded pawl to the second end of the second handle, selectively interacting the first pawl with the toothed notches of the adjusting bar through the first slot, selectively interacting a second spring-loaded pawl with the toothed notches of the adjusting bar through the first slot, providing a release mechanism cooperating with the adjusting bar, squeezing the second handle toward the first handle, moving the adjusting bar with the first pawl and the second pawl in a direction toward the second end of the first handle thereby moving the second jaw portion in a general direction toward the first jaw portion, releasing the handle, releasably locking the first pawl and the second pawl into place on the adjusting bar, readjusting the handle relative to the first pawl, continuing squeezing of the second handle until the work piece is secured between the first jaw portion and the second jaw portion, rotating the release mechanism until the toothed notches are rotated out of contact with the first pawl and the second pawl, moving the second jaw portion in a general direction away from the first jaw portion, and releasing the work piece.

The present invention further includes a viper crescent wrench device for holding a work piece. The viper crescent wrench device comprises a first handle having an open first end and a second end with a first slot formed in the first handle. A first jaw portion is secured to the second end of the first handle. An adjusting bar is rotatably mounted within the first handle with the adjusting bar having a first end and a second end. A plurality of toothed notches is formed on at least one side of the adjusting bar. A first spring biases the adjusting bar toward the first end of the first handle. A second jaw portion is mounted to the second end of the adjusting bar with the second jaw portion movable toward and away from the first jaw portion. A second handle is provided having a first end and a second end with the first end of the second handle pivotable in a direction toward the first handle. A second spring biases the first end of the second handle in a general direction away from the first handle. A first spring-loaded pawl is pivotally mounted to the second end of the second handle with the first pawl selectively interacting with the toothed notches of the adjusting bar through the first slot. A capsule is mounted over the first slot with the first pawl rotatably connected to the capsule and biased in a general direction toward the first end of the first handle. A release mechanism cooperates with the adjusting bar to rotate the toothed notches of the adjusting bar out of contact with the first pawl. Upon squeezing the second handle toward the first handle, the first pawl moves the adjusting bar, by action on the toothed notches, in a direction toward the second end of the first handle thereby moving the second jaw portion in a general direction toward the first jaw portion. Upon releasing the second handle, the first pawl releasably locks into place on the adjusting bar and the second handle readjusts relative to the first pawl thereby repositioning under bias of the second spring to do the same action again when the second handle is squeezed again until the work piece is secured between the first jaw portion and the second jaw portion. Upon rotation of the release mechanism, the toothed notches are rotated out of contact with the first pawl and the second pawl such that the second jaw portion moves in a general direction away from the first jaw portion under bias of the first spring thereby releasing the work piece.

BRIEF DESCRIPTION OF THE DRAWINGS

FIG. 4 is a perspective view illustrating a compartment of the viper crescent wrench device, constructed in accordance with the present invention;

FIG. 5 is a perspective view illustrating a release mechanism of the viper crescent wrench device, constructed in accordance with the present invention, useable with the compartment of FIG. 4;

FIG. 6 is a perspective view illustrating a pin of the viper crescent wrench device, constructed in accordance with the present invention, for connecting the release mechanism to the compartment of FIG. 4;

FIG. 7 is an elevation side view illustrating a spring of the viper crescent wrench device, constructed in accordance with the present invention;

FIG. 8 is an exploded perspective side view illustrating an adjusting bar of the viper crescent wrench device, constructed in accordance with the present invention, seated within the compartment of FIG. 4;

FIG. 9 is another exploded perspective side view illustrating an adjusting bar of the viper crescent wrench device, constructed in accordance with the present invention, seated within the compartment of FIG. 4;

FIG. 10 is a perspective view illustrating another embodiment of the compartment of the viper crescent wrench device, constructed in accordance with the present invention;

FIG. 11 is a perspective side view illustrating an adjusting bar of the viper crescent wrench device, constructed in accordance with the present invention, seated within the compartment of FIG. 10;

FIG. 12 is another perspective side view illustrating an adjusting bar of the viper crescent wrench device, constructed in accordance with the present invention, seated within the compartment of FIG. 10;

FIG. 13 is a perspective view illustrating the release mechanism of the viper crescent wrench device, constructed in accordance with the present invention, useable with the compartment of FIG. 10;

FIG. 14 is a bottom perspective view illustrating a second jaw portion of the viper crescent wrench device, constructed in accordance with the present invention;

FIG. 15 is a bottom view illustrating the second jaw portion of the viper crescent wrench device, constructed in accordance with the present invention;

FIG. 16 is an exploded perspective view illustrating a first pawl of the viper crescent wrench device, constructed in accordance with the present invention;

FIG. 17 is a sectional exploded perspective view illustrating the first pawl of the viper crescent wrench device, constructed in accordance with the present invention;

FIG. 18 is a perspective view illustrating a second pawl of the viper crescent wrench device, constructed in accordance with the present invention;

FIG. 23 is a sectional perspective view illustrating the compartment for the viper crescent wrench device of FIG. 20, constructed in accordance with the present invention;

FIG. 24 is a perspective view illustrating the adjusting bar of the viper crescent wrench device of FIG. 20, constructed in accordance with the present invention;

FIG. 25 is a perspective view illustrating the adapter of the viper crescent wrench device of FIG. 20, constructed in accordance with the present invention;

FIG. 26 is a perspective view illustrating the moving piece of the viper crescent wrench device of FIG. 20, constructed in accordance with the present invention;

FIG. 27 is a perspective view illustrating the second jaw portion of the viper crescent wrench device of FIG. 20, constructed in accordance with the present invention;

FIG. 28 is a perspective view illustrating the first jaw portion of the viper crescent wrench device of FIG. 20, constructed in accordance with the present invention;

FIG. 33 is a perspective view illustrating the stationary handle of the viper crescent wrench device of FIG. 29, constructed in accordance with the present invention;

FIG. 34 is a perspective view illustrating the spring-loaded handle of the viper crescent wrench device of FIG. 29, constructed in accordance with the present invention;

FIG. 35 is a perspective view illustrating the second jaw portion of the viper crescent wrench device of FIG. 29, constructed in accordance with the present invention;

FIG. 36 is a perspective view illustrating the moving piece of the viper crescent wrench device of FIG. 29, constructed in accordance with the present invention;

FIG. 37 is a perspective view illustrating the first pawl of the viper crescent wrench device of FIG. 29, constructed in accordance with the present invention; and FIG. 38 is a perspective view illustrating a part of the viper crescent wrench device of FIG. 29, constructed in accordance with the present invention.

DETAILED DESCRIPTION OF THE PREFERRED EMBODIMENTS

Figure 1:
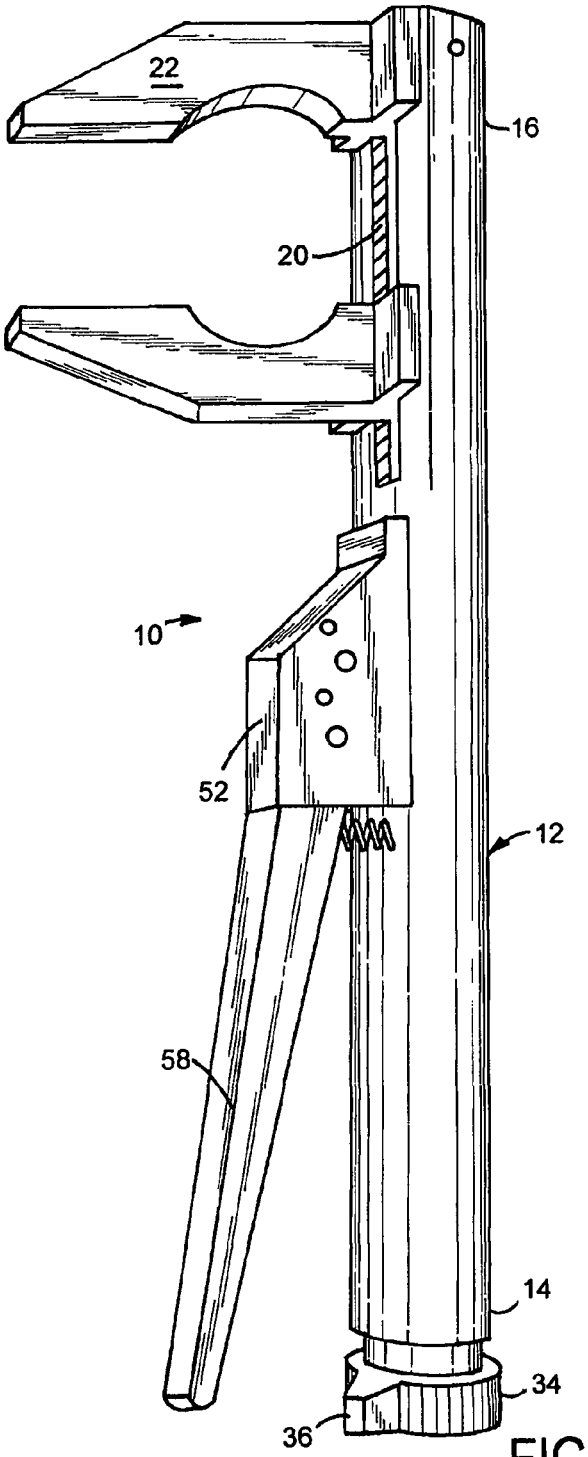
FIG. 1 is a perspective view illustrating a viper crescent wrench device, constructed in accordance with the present invention.
Figure 2:
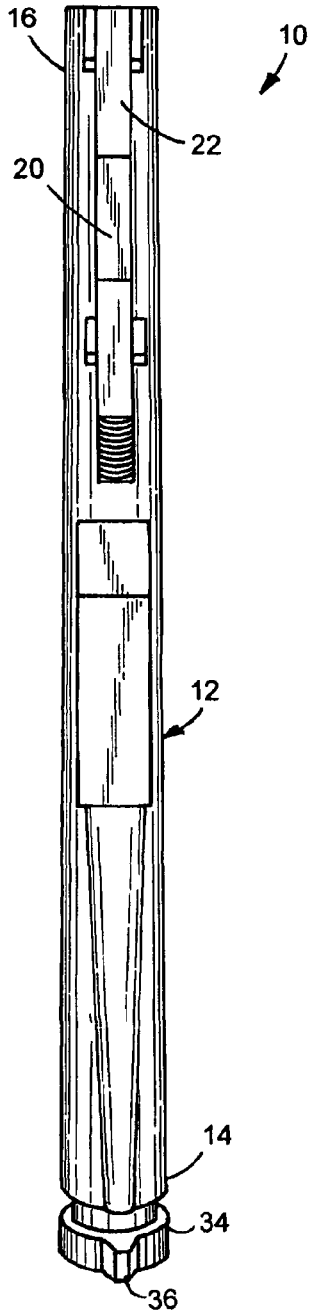
FIG. 2 is an elevational side view illustrating the viper crescent wrench device, constructed in accordance with the present invention.
Figure 3:
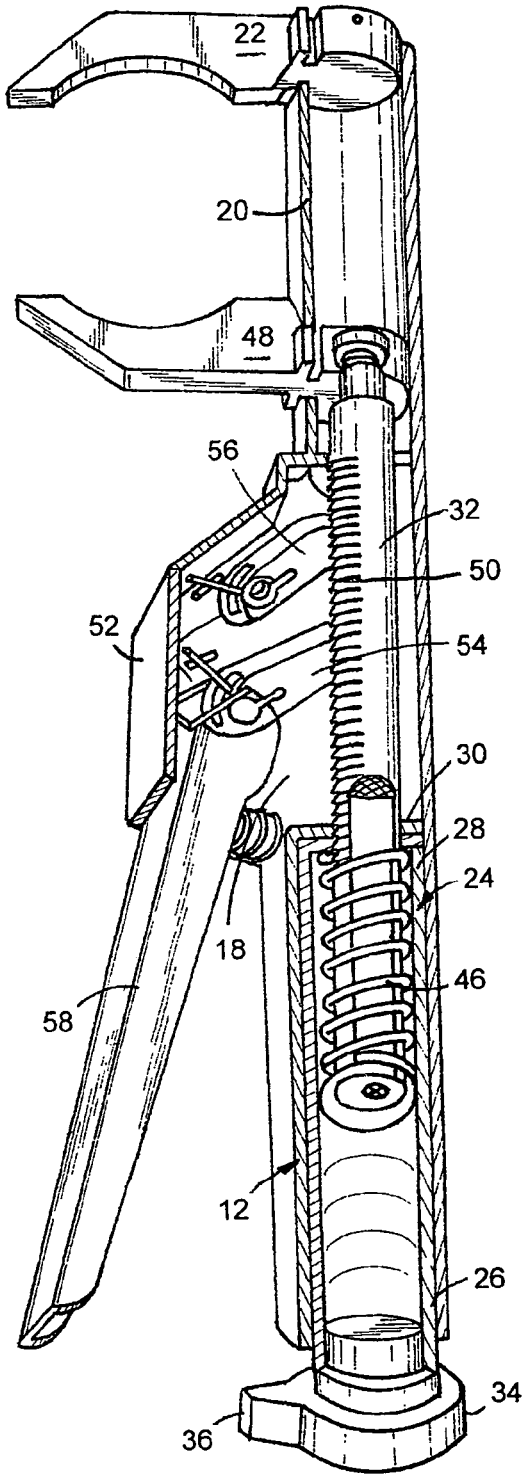
FIG. 3 is a sectional perspective view illustrating the viper crescent wrench device, constructed in accordance with the present invention.
Figure 19:
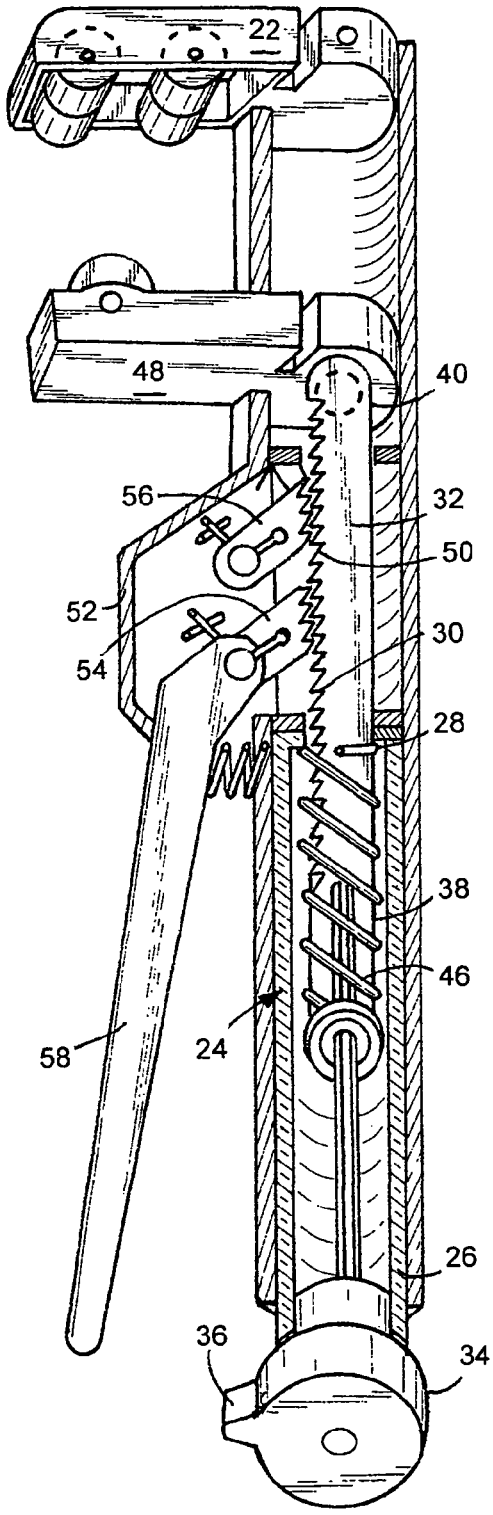
FIG. 19 is a perspective view illustrating the viper crescent wrench device, constructed in accordance with the present invention, with a pipe cutter replacing the first and second jaw portions.
Figure 20:
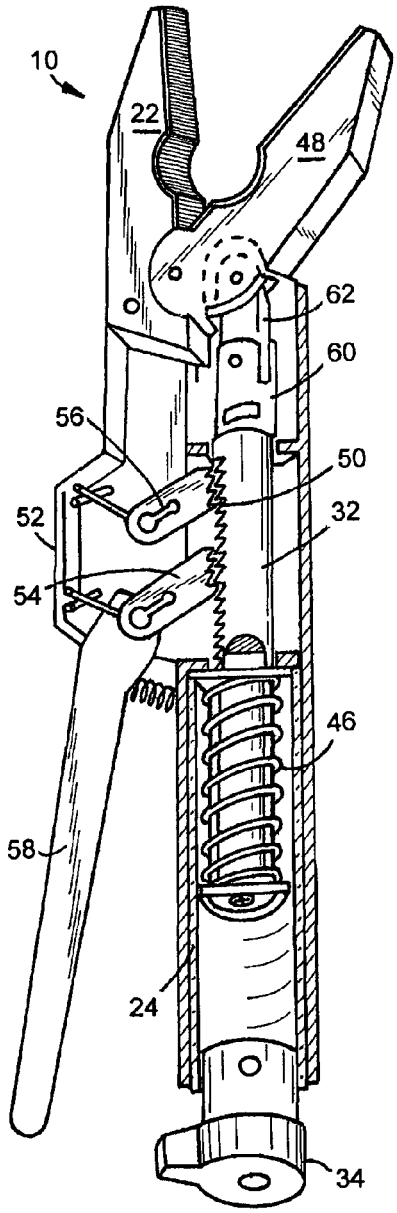
FIG. 20 is a perspective view illustrating another embodiment of the viper crescent wrench device, constructed in accordance with the present invention, with the first and second jaw portions being in an open position.
Figure 21:
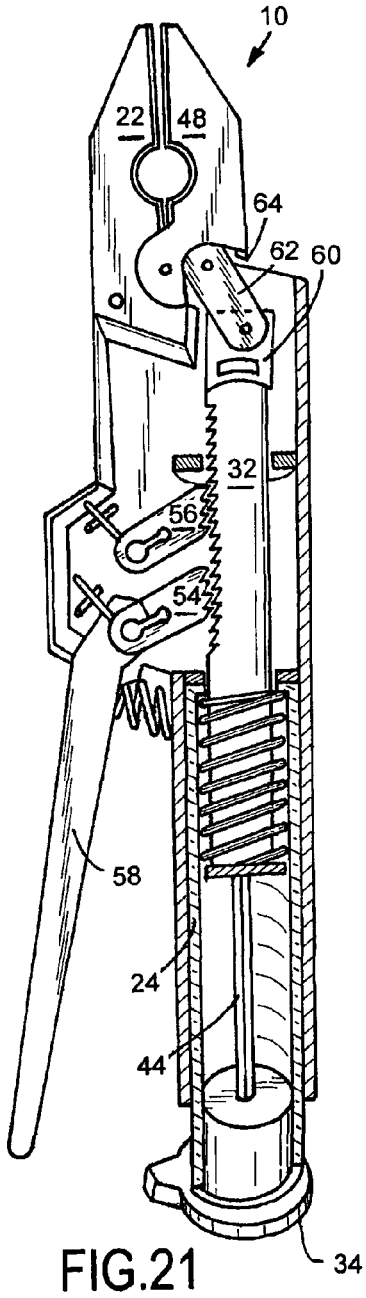
FIG. 21 is a perspective view illustrating the viper crescent wrench device of FIG. 20, constructed in accordance with the present invention, with the first and second jaw portions being in a closed position.
Figure 22:
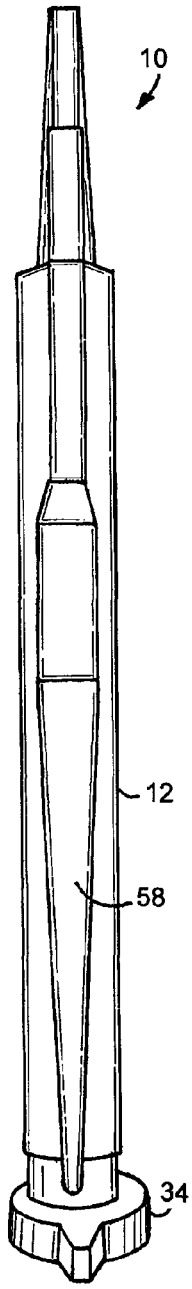
FIG. 22 is an elevational side view illustrating the viper crescent wrench device of FIG. 20, constructed in accordance with the present invention.
Figure 29:
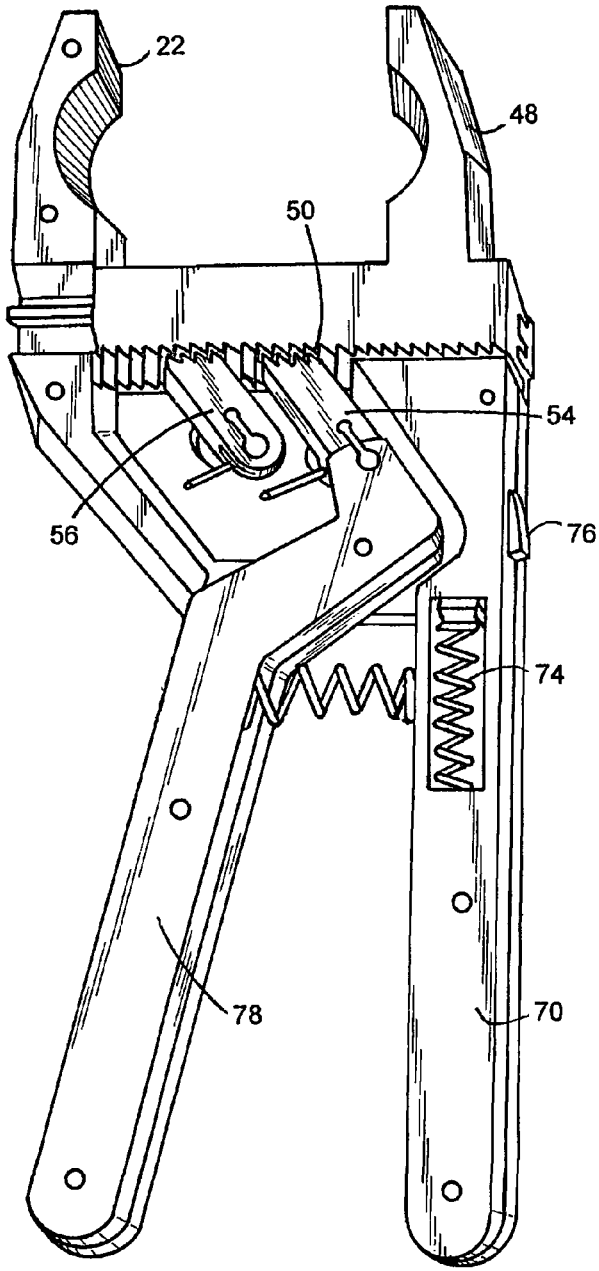
FIG. 29 is a perspective view illustrating still another embodiment of the viper crescent wrench device, constructed in accordance with the present invention.
Figure 30:
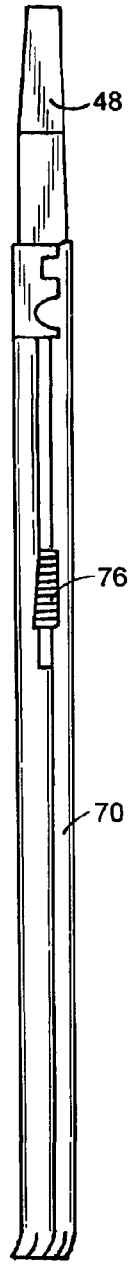
FIG. 30 is a right side view illustrating the viper crescent wrench device of FIG. 29, constructed in accordance with the present invention.
Figure 31:
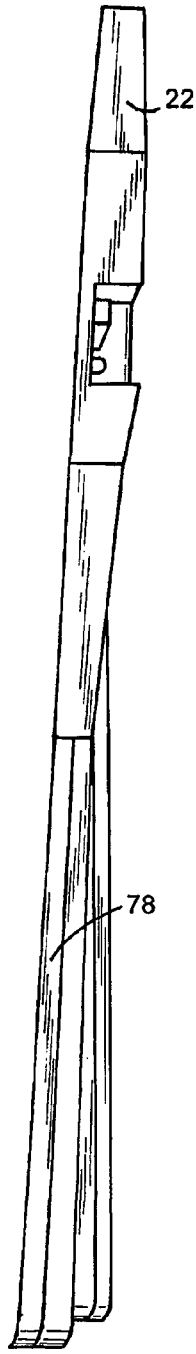
FIG. 31 is a left side view illustrating the viper crescent wrench device of FIG. 29, constructed in accordance with the present invention.
Figure 32:
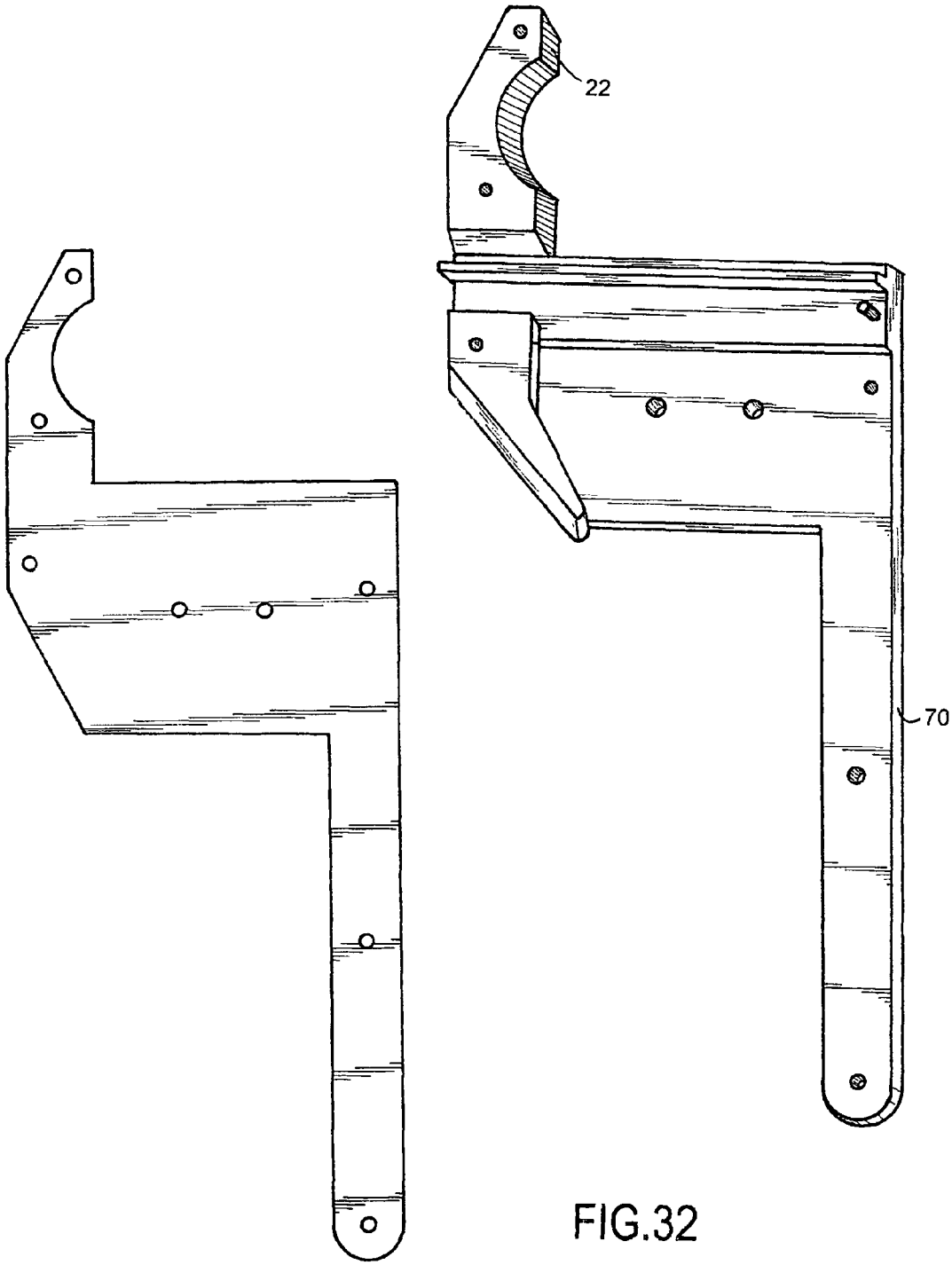
FIG. 32 is a perspective view illustrating the first jaw portion of the viper crescent wrench device of FIG. 29, constructed in accordance with the present invention.

As illustrated in FIGS. 1 and 2, the present invention is a viper crescent wrench device, indicated generally at 10, creating an improved wrench for mechanical work. Basically, viper crescent wrench device 10 of the present invention is an adjustable, straight jawed wrench for mechanical work, featuring a unique, spring-loaded, tooth-and-lever channel system in which squeezing the wrench's handle causes the bottom jaw of the tool to exact increased force and a tighter fit on stubborn nuts, bolts, and other hard-to-turn fasteners and releasing the wrench's jaws is accomplished by turning and pulling a simple release bar at the base of the first handle.

As best illustrated in FIGS. 1-19, the viper crescent wrench device 10 of the present invention has an elongated hollow first handle 12 having an open first end 14 and a second end 16. A first slot 18 is formed in the approximate center of the first handle 12 and a second slot 20 is formed between the first slot 18 and the second end 16 of the first handle 12. A fixed, non-movable first jaw portion 22 is secured to the second end 16 of the first handle 12. The outer surface of the first handle 12 can be sheathed in foam or rubber with shallow grooves for enhanced gripping of the first handle 12.

In addition, the viper crescent wrench device 10 of the present invention has a compartment 24 formed adjacent the first end 14 of the first handle 12 with the compartment 24 having an open first end 26 and a second end 28. The first end 26 of the compartment 24 is positioned flush with the first end 14 of the first handle 12 and the second end 28 of the compartment 24 has an opening 30 for slidably receiving an adjusting bar 32. Rotatably and releasably secured within the open first end 26 of the compartment 24 is a release mechanism 34. Preferably, the release mechanism 34 is a round disc having a nub or protrusion 36 for allowing a better grasp of the release mechanism 34. Rotation of the release mechanism 34 also rotates the adjusting bar 32, as will be described in further detail below.

As stated above, the adjusting bar 32 of the viper crescent wrench device 10 of the present invention is slidably movable within the opening 30 in the second end 28 of the compartment 24. The adjusting bar 32 has a first end 38 positioned within the compartment 24 and a second end 40 positioned nearingly adjacent the second end 16 of the first handle 14. The adjusting bar 32 has two embodiments. In a first embodiment, the first end 40 of the adjusting bar 32 has truncated sides corresponding to the shape of the opening 30 in the second end 28 of the compartment 24 with a pin 42 connecting the release mechanism 34 to the first end 26 of the compartment 24. In this embodiment, as the release mechanism 34 is rotated, so is both the compartment 24 and the adjusting bar 32. In a second embodiment, the release mechanism 34 is connected to the adjusting bar 32 by an elongated connecting rod 44 such that as the release mechanism 34 is rotated, so is the adjusting bar 32. In either embodiment, a spring 46 is positioned between the first end 38 of the adjusting bar 32 and the second end 28 of the compartment 24 biasing the adjusting bar 32 in a general direction toward the first end 14 of the first handle 12. A second jaw portion 48 is mounted to the second end 40 of the adjusting bar 32, preferably by a threaded nut and bolt, and is movable toward and away from the first jaw portion 22, as will be described in further detail below.

The adjusting bar 32 of the viper crescent wrench device 10 of the present invention has a continuous series of toothed notches 50 formed on one side of the adjusting bar 32 between the first end 38 and the second end 40 of the adjusting bar 32 and is smooth on another side of the adjusting bar 32 between the first end 38 and the second end 40 of the adjusting bar 32. A capsule 52 is mounted over the first slot 18 formed in the first handle 12. Within the capsule 52 is a pair of movable, spring-loaded, and releasably locking pawls, i.e. a first pawl 54 and a second pawl 56, selectively interacting with the toothed notches 50 formed in the adjusting bar 32 by means of which the second jaw portion 48 can be moved relative to the first jaw portion 22. Both the first pawl 54 and the second pawl 56 are rotatably connected to the capsule 52 and biased in a general direction toward the first end 14 of the first handle 12.

The viper crescent wrench device 10 of the present invention further includes a spring-loaded second handle 58 connected to the first pawl 54 such that by squeezing the second handle 58 causes the first pawl 54 to move the adjusting bar 32, by action on the toothed notches 50, in a direction toward the second end 16 of the first handle 12 enabling the user to move the second jaw portion 48 upward within the second slot 20 of the first handle 12 toward the first jaw portion 22. When the second handle 58 is released, the first pawl 54 and the second pawl 56 releasably lock into place and the second handle 58 readjusts relative to the first pawl 54 thereby repositioning itself to do the same action again when the second handle 58 is squeezed again. The squeezing and releasing action of the second handle 58 can be continued until a work piece is firmly secured between the first jaw portion 22 and the second jaw portion 48.

To release the work piece from between the first jaw portion 22 and the second jaw portion 48 of the viper crescent wrench device 10 of the present invention, the release mechanism 34 is rotated in either direction. Rotation of the release mechanism 34 causes the adjusting bar 32 to rotate the toothed notches 50 out of contact with the first pawl 54 and the second pawl 56. The adjusting bar 32, by action of the spring 46, automatically slides through the opening 30 in the compartment 24 toward the first end 14 of the first handle 12 causing the second jaw portion 48 to move away from the first jaw portion 22 thereby releasing the work piece.

Instead of the first jaw portion 22 and the second jaw portion 48 of the viper crescent wrench device 10 of the present invention being configured as gripping devices, as described and illustrated, the first jaw portion 22 and the second jaw portion 48 can be configured as a pipe cutter. Operation of the viper crescent wrench device 10 is the same for clamping a section of pipe between the first jaw portion 22 and the second jaw portion 48 and then cutting the pipe, as per usual.

As best illustrated in FIGS. 20-28, in another embodiment of the viper crescent wrench device 10 of the present invention, the second jaw portion 48 pivots, rather than slides, relative to the first jaw portion 22. In this embodiment, the second end 16 of the first handle 12 is also open. Attached to the second end 40 of the adjusting bar 32 is an adapter 60. The adapter 60 has a moving piece 62 pivotally connected between the adapter 60 and the second jaw portion 48 for pivoting the second jaw portion 48 relative to the first jaw portion 22. The second jaw portion 48 has a notch 64 for receiving the moving piece 62 such that as the first pawl 54 and the second pawl 56 move the adjusting bar 32 toward the second end 16 of the first handle 12, the action of the moving piece 62 in the notch 64 pivots the second jaw portion 48 toward the first jaw portion 22. Upon rotating of the release mechanism 34, the adjusting bar 32 moves in a direction toward the first end 14 of the first handle 12 rotating the second jaw portion 48 away from the first jaw portion 22.

As best illustrated in FIGS. 29-38, in still another embodiment of the viper crescent wrench device 10 of the present invention, the first jaw portion 22 and the second jaw portion 48 are oriented and move parallel to each other in a vertical position rather than in a horizontal position. The viper crescent wrench device 10 has a stationary handle 70 having a first end and a second end with at least a portion of a moving plate 72 slidably mounted to the stationary handle 70. A spring 74 biases the moving plate 72 toward the second end of the stationary handle 70. A thumb protrusion 76 extends from the moving plate 72 out of the stationary handle 70 allowing a user to move the moving plate 72 against the bias of the spring 74.

Rotatably secured to moving plate 72 of the viper crescent wrench device 10 of the present invention is the spring-loaded handle 78. The first pawl 54 is rotatably secured to the spring-loaded handle 78 with the first pawl 54 and the second pawl 56 selectively engaging the toothed notches 50 formed on the underside of the second jaw portion 48. Squeezing of the spring-loaded handle 78 causes the first pawl 54 and the second pawl 56 to move the second jaw portion 48 in a general direction toward the first jaw portion 22. To move the second jaw portion 48 away from the first jaw portion 22, the moving plate 72 is moved in a downward direction by the thumb protrusion 76 against the bias of the spring 74 wherein the moving plate 72 moves the first pawl 54 and the second pawl 56 out of contact with the toothed notches 50 on the second jaw portion 48 such that a spring causes the second jaw portion 48 to move away from the first jaw portion 22.

As can be understood, the viper crescent wrench device 10 presents itself as an adjustable wrench with superior leverage and an exceptionally secure gripping capability. The viper crescent of the present invention offers householders, as well as professional tradesmen such as mechanics, a tool of uncommon range and utility. Foremost, the viper crescent wrench device 10 offers not just an adjustable straight-jawed wrench, but a wrench whose range of adjustment, e.g., the gap possible between the upper and lower jaws, exceeds by far that of virtually any other commercially available, mass-production wrench. Now by itself, the opening range of the jaws is of little use if the wrench lacks sufficient leverage. However, the long, straight handle and gripping chassis of the viper crescent wrench device 10 offers the mechanic the superior leverage only possible with a long, levering action. Fabricated of the highest quality, tool-grade chrome vanadium steel, the viper crescent wrench device 10 is tough, durable, virtually unbreakable, and resistant to rust and corrosion. Beyond a drop of household oil once in a while to keep the handle mechanism lubricated, the viper crescent wrench device 10 requires no particular maintenance, and can be relied upon to provide a lifetime of faithful service.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein may be suitably practiced in the absence of the specific elements which are disclosed herein.

What is claimed is:

1. A viper crescent wrench device for holding a work piece, the viper crescent wrench device comprising:

a hollow first handle having an open first end and a second end;

a first slot formed in the first handle;

a fixed, non-movable first jaw portion secured to the second end of the first handle;

an adjusting bar rotatably mounted within the first handle, the adjusting bar having a first end and a second end;

a plurality of toothed notches formed on one side of the adjusting bar;

a first spring for biasing the adjusting bar toward the first end of the first handle;

a second jaw portion mounted to the second end of the adjusting bar, the second jaw portion movable toward and away from the first jaw portion;

a second handle pivotable relative to the first handle, the second handle having a first end and a second end;

a second spring for biasing the first end of the second handle in a general direction away from the first handle;

a first spring-loaded pawl pivotally mounted to the second end of the second handle, the first spring-loaded pawl selectively interacting with the toothed notches of the adjusting bar through the first slot;

a second spring-loaded pawl selectively interacting with the toothed notches of the adjusting bar through the first slot; and a release mechanism cooperating with the adjusting bar to rotate toothed notches of the adjusting bar out of contact with the first pawl and the second pawl;

wherein upon squeezing the second handle toward the first handle, the first pawl and the second pawl move the adjusting bar, by action on the toothed notches, in a direction toward the second end of the first handle thereby moving the second jaw portion in a general direction toward the first jaw portion;

wherein upon releasing the second handle, the first pawl and the second pawl releasably lock into place on the adjusting bar and the second handle readjusts relative to the first pawl thereby repositioning under bias of the second spring to do the same action again when the second handle is squeezed again until the work piece is secured between the first jaw portion and the second jaw portion; and wherein upon rotation of the release mechanism, the toothed notches are rotated out of contact with the first pawl and the second pawl such that the second jaw portion moves in a general direction away from the first jaw portion under bias of the first spring thereby releasing the work piece.

2. The viper crescent wrench device of claim 1 wherein the first jaw portion and the second jaw portion are selected from the group consisting of gripping devices and a pipe cutter.

3. The viper crescent wrench device of claim 1 and further comprising:

a compartment formed adjacent the first end of the first handle, the compartment having an open first end and a second end, the first end being positioned flush with the first end of the first handle and the second end having an opening for slidably receiving the adjusting bar.

4. The viper crescent wrench device of claim 3 wherein the adjusting bar has the first end positioned within the compartment and the second end positioned nearingly adjacent the second end of the first handle, the second end of the adjusting bar having truncated sides corresponding to the shape of the opening in the second end of the compartment with a pin connecting the release mechanism to the first end of the compartment such that as the release mechanism is rotated, so is both the compartment and the adjusting bar.

5. The viper crescent wrench device of claim 3 wherein the adjusting bar has the first end positioned within the compartment and the second end positioned nearingly adjacent the second end of the first handle, the release mechanism is connected to the adjusting bar by an elongated connecting rod such that as the release mechanism is rotated, so is the adjusting bar.

6. The viper crescent wrench device of claim 3 wherein the first spring is positioned between the first end of the adjusting bar and the second end of the compartment biasing the adjusting bar in a general direction toward the first end of the first handle.

7. The viper crescent wrench device of claim 1 wherein the first slot is formed in the approximate center of the first handle and further comprising:

a second slot formed between the first slot and the second end of the first handle, the second jaw portion movable along the second slot.

8. The viper crescent wrench device of claim 7 and further comprising:

a capsule is mounted over the first slot formed in the first handle, the first pawl and the second pawl rotatably connected to the capsule and biased in a general direction toward the first end of the first handle.

9. The viper crescent wrench device of claim 1 wherein the release mechanism is a round disc having a nub allowing a better grasp of the release mechanism.

10. The viper crescent wrench device of claim 1 wherein the second jaw portion pivots relative to the first jaw portion.

11. The viper crescent wrench device of claim 10 wherein the second end of the first handle is open, and further comprising:

an adapter attached to the second end of the adjusting bar;

a moving piece pivotally connected between the adapter and the second jaw portion for pivoting the second jaw portion relative to the first jaw portion;

wherein the second jaw portion has a notch for receiving the moving piece such that as the first pawl and the second pawl move the adjusting bar toward the second end of the first handle, the action of the moving piece in the notch pivots the second jaw portion toward the first jaw portion.

12. The viper crescent wrench device of claim 1 wherein the first jaw portion and the second jaw portion are substantially perpendicular to the first handle.

13. The viper crescent wrench device of claim 1 wherein the first jaw portion and the second jaw portion are substantially parallel to the first handle.

14. The viper crescent wrench device of claim 1 wherein the first slot is formed in the approximate center of the first handle and further comprising:

a second slot formed between the first slot and the second end of the first handle, the second jaw portion movable along the second slot.

15. A method for holding a work piece, the method comprising:

providing a hollow first handle having an open first end and a second end;

forming a first slot in the first handle;

securing a fixed, non-movable first jaw portion to the second end of the first handle;

rotatably mounting an adjusting bar within the first handle, the adjusting bar having a first end and a second end;

forming a plurality of toothed notches on one side of the adjusting bar;

biasing the adjusting bar toward the first end of the first handle;

mounting a second jaw portion to the second end of the adjusting bar, the second jaw portion movable toward and away from the first jaw portion;

pivotally mounting a second handle relative to the first handle, the second handle having a first end and a second end;

biasing the first end of the second handle in a general direction away from the first handle;

pivotally mounting a first spring-loaded pawl to the second end of the second handle;

selectively interacting the first spring-loaded pawl with the toothed notches of the adjusting bar through the first slot;

selectively interacting a second spring-loaded pawl with the toothed notches of the adjusting bar through the first slot;

providing a release mechanism cooperating with the adjusting bar;

squeezing the second handle toward the first handle;

moving the adjusting bar with the first pawl and the second pawl in a direction toward the second end of the first handle thereby moving the second jaw portion in a general direction toward the first jaw portion;

releasing the handle;

releasably locking the first pawl and the second pawl into place on the adjusting bar;

readjusting the handle relative to the first pawl;

continuing squeezing of the second handle until the work piece is secured between the first jaw portion and the second jaw portion;

rotating the release mechanism until the toothed notches are rotated out of contact with the first pawl and the second pawl;

moving the second jaw portion in a general direction away from the first jaw portion; and releasing the work piece.

16. A viper crescent wrench device for holding a work piece, the viper crescent wrench device comprising:

a first handle having an open first end and a second end;

a first slot formed in the first handle;

a first jaw portion secured to the second end of the first handle;

an adjusting bar rotatably mounted within the first handle, the adjusting bar having a first end and a second end;

a plurality of toothed notches formed on at least one side of the adjusting bar;

a first spring for biasing the adjusting bar toward the first end of the first handle;

a second jaw portion mounted to the second end of the adjusting bar, the second jaw portion movable toward and away from the first jaw portion;

a second handle having a first end and a second end, the first end of the second handle pivotable in a direction toward the first handle a second spring for biasing the first end of the second handle in a general direction away from the first handle;

a first spring-loaded pawl pivotally mounted to the second end of the second handle, the first spring-loaded pawl selectively interacting with the toothed notches of the adjusting bar through the first slot;

a capsule mounted over the first slot, the first pawl rotatably connected to the capsule and biased in a general direction toward the first end of the first handle; and a release mechanism cooperating with the adjusting bar to rotate the toothed notches of the adjusting bar out of contact with the first pawl;

wherein upon squeezing the second handle toward the first handle, the first pawl moves the adjusting bar, by action on the toothed notches, in a direction toward the second end of the first handle thereby moving the second jaw portion in a general direction toward the first jaw portion;

wherein upon releasing the second handle, the first pawl releasably locks into place on the adjusting bar and the second handle readjusts relative to the first pawl thereby repositioning under bias of the second spring to do the same action again when the second handle is squeezed again until the work piece is secured between the first jaw portion and the second jaw portion; and wherein upon rotation of the release mechanism, the toothed notches are rotated out of contact with the first pawl and the second pawl such that the second jaw portion moves in a general direction away from the first jaw portion under bias of the first spring thereby releasing the work piece.

17. The viper crescent wrench device of claim 16 and further comprising:

a second spring-loaded pawl selectively interacting with the toothed notches of the adjusting bar through the first slot, the second pawl positioned under and attached to the capsule.

18. The viper crescent wrench device of claim 5 and further comprising:

a compartment formed adjacent the first end of the first handle, the compartment having an open first end and a second end, the first end being positioned flush with the first end of the first handle and the second end having an opening for slidably receiving the adjusting bar.

19. The viper crescent wrench device of claim 18 wherein the adjusting bar has the first end positioned within the compartment and the second end positioned nearingly adjacent the second end of the first handle, the second end of the adjusting bar having truncated sides corresponding to the shape of the opening in the second end of the compartment with a pin connecting the release mechanism to the first end of the compartment such that as the release mechanism is rotated, so is both the compartment and the adjusting bar.

20. The viper crescent wrench device of claim 18 wherein the adjusting bar has the first end positioned within the compartment and the second end positioned nearingly adjacent the second end of the first handle, the release mechanism is connected to the adjusting bar by an elongated connecting rod such that as the release mechanism is rotated, so is the adjusting bar.

* * * * *